United States Patent [19]

Seeger et al.

[11] 4,264,477

[45] Apr. 28, 1981

[54] KEYBOARD

[75] Inventors: Richard E. Seeger, Topsfield; Vincent Squitieri, Billerica, both of Mass.

[73] Assignee: Chomerics, Inc., Woburn, Mass.

[21] Appl. No.: 879,144

[22] Filed: Feb. 21, 1978

[51] Int. Cl.[3] ..... H01B 1/04

[52] U.S. Cl. ..... 252/503; 252/511; 200/265

[58] Field of Search ..... 252/503, 511; 200/265

[56] References Cited

U.S. PATENT DOCUMENTS

| | | | |
|---|---|---|---|
| 2,866,057 | 12/1958 | Peck | 252/503 X |
| 3,173,885 | 3/1965 | Short | 252/503 |
| 3,860,771 | 1/1975 | Lynn et al. | 200/5 A |
| 4,066,851 | 1/1978 | White et al. | 200/5 A |

*Primary Examiner*—Benjamin R. Padgett
*Assistant Examiner*—J. L. Barr
*Attorney, Agent, or Firm*—Dike, Bronstein, Roberts, Cushman & Pfund

[57] ABSTRACT

Keyboard having contactors and contacts which are selectively urged against one another by depression causing engagement of one by the other, the keyboard having at least contactors or contacts or both which are constructed of a conductive polymeric composition such that upon engagement of a contactor with a contact there is exhibited substantially reduced bounce after repeated closure of contactor against contact even at micro ampere current levels.

14 Claims, 4 Drawing Figures

KEYBOARD

BACKGROUND OF THE DISCLOSURE

This invention is an improvement over the keyboards such as shown in U.S. Pat. Nos. 3,860,771 and 4,066,851.

While these keyboards have proven to be eminently successful in most applications it has been discovered that after repeated closure of contactor against contact, such as 100,000 to 200,000 closures when the keyboard is being used at low current levels, that bounce (defined as repeated opening and closing or substantial change in resistance between contactor and contact) has developed and has produced multiple data entries.

While 100,000 closures for a keyboard may be acceptable in certain situations, most users require at least one to two million acceptable closures.

The precise reason for the bounce problems at low current levels with the aforementioned keyboards is to this day still not understood by applicants. However, after presistent effort and considerable experimental work, applicants have now experimentally discovered a solution to this perplexing problem. However, the reason for the composition experimentally discovered herein providing reduced bounce is still not understood by applicants.

BRIEF DESCRIPTION OF THE INVENTION

The invention is directed to keyboard switches, keyboard circuitry or circuit patterns including switch portions comprising contacts and contactors and is most particularly directed to an electrically conductive ink which may be screened and which, when dry, provides quite acceptable switch operation at low current levels, i.e., micro ampere levels without bounce being a substantial factor even after 1 million or more switch closures. The circuitry formed with the ink of the invention may be of any suitable width and generally has a thickness of less than about 2.5 mils for cost reasons with a thickness of about 0.5 and 1.5 mils being preferred and about 0.75 to 1 mil being most preferred. The dried ink composition of this invention has as the improvement the inclusion of about 0.5 to about 12.5% of carbon black powder (particles) by weight to correct for bounce at low current operation. However, it should be understood that the thickness of the dry ink may vary over a wide range, e.g., up to 100 mils and more.

DETAILED DESCRIPTION OF THE INVENTION

Figure 1:
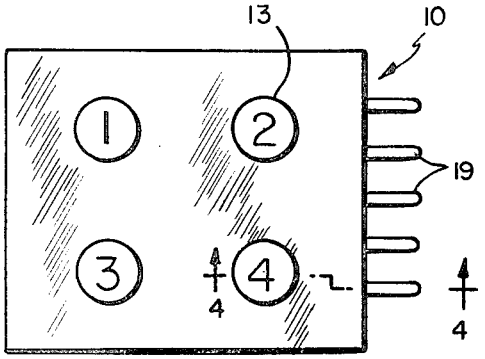
FIG. 1 is a top view of a typical keyboard.
Figure 3:
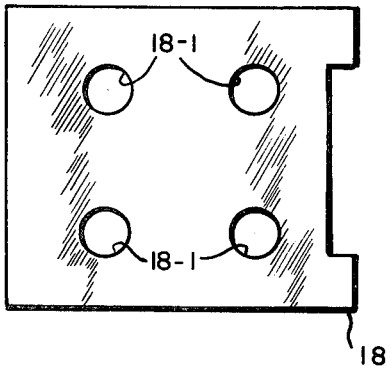
FIG. 3 is a top view of an insulator snap through layer for insulating circuit pattern portions from one another when the keyboard is assembled.
Figure 2:
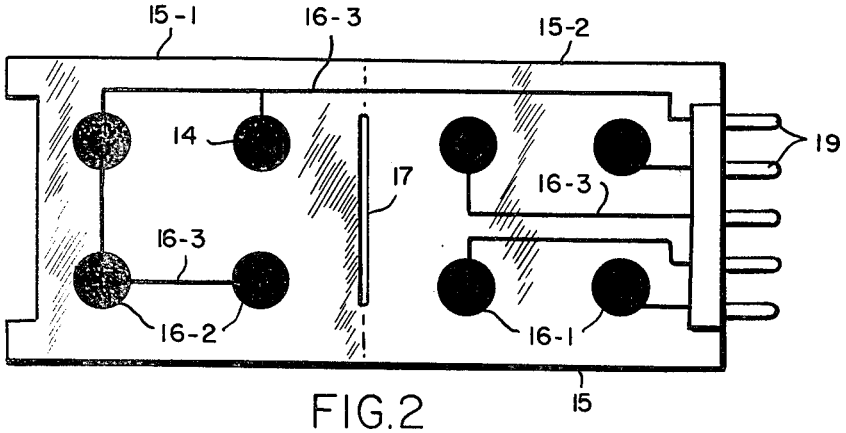
FIG. 2 is a top view of a foldover insulator substrate for the circuit pattern of the keyboard having contactors and contacts.

The invention relates to keyboard switches and the like and more particularly relates to a new and improved conductive screening ink and the dry (solid) circuitry formed therefrom forming switch contactors and contacts of a keyboard or the like which function without substantial bounce at low currents with the number of acceptable contactor to contact closures of the switches of the keyboard being in the millions.

In particular, the dried ink comprises about 0.5 to 12.5% with about 1 to 10% being more preferred and 1 to 5% being most preferred by weight of carbon black. The most highly electrically conductive carbon black available is used and preferably has a particle size less than about 300 milli microns. It has been discovered that with less than about 0.5% carbon black by weight, the bounce effect is not substantially alleviated. It has also been discovered if the carbon content is greater than about 12.5% by weight, the resistance is considerably greater than desired and does not meet the requirements of most keyboard users who require low contact resistance at low currents. It should, however, be understood that 12.5% as the upper limit may vary slightly depending on user requirements and, in practice, at this time, applicants prefer for most applications, an upper carbon black limit of about 10%. The same holds true for the lower limit of 0.5% in that it may vary ± a small amount, however, at this time, applicants prefer a lower limit of about 1% carbon black.

The amount of electrically conductive metal particles is preferably about 60 to 90% by weight with about 65 to 85% being most preferable because of resistance values, cost and adherence to the sheet, i.e., the substrate. The metal particles may comprise the noble metals or other metals, e.g., nickel, metal coated particles (both conductive and non-conductive cores), e.g., silver coated copper, silver coated glass, etc., however, the most preferred is silver by itself. Particle sizes are preferably such as that about substantially 100% of particles pass throgh a −325 mesh screen. Flakes, rather than irregular shaped particles, are most preferred for screening surfaces since they tend to lie flat when being screened.

The particle, metal and carbon black are held together by a polymeric binder preferably a plastic such as a polyester. However, other plastics such as acrylic, epoxy, vinyl and others apparent to those skilled in the art may be used as long as they adhere sufficiently to the underlying substrate as would be apparent to those skilled in the art. The amount of binder in the dry ink is preferably 6 to 30% by weight with 12 to 18% being most preferred. It should be understood that most binders are used as liquids during manufacture and contain a percentage of solids and a solvent. When the solvent is driven off or evaporated, the remainder is substantially the binder solids. As used herein, the percentages are in terms of weight and are given as a percentage of the total weight of the electrically conductive metal particles, polymeric binder and carbon black. The substrate or sheet on which the circuit is screened may comprise polyester, e.g., MYLAR as well as other materials such as acrylic, epoxy, vinyl, polyamide, and other conventional materials which are electrically non-conductive.

In the screening ink per se (before drying) the ingredients preferably comprise by weight about 35 to 80% polymeric binder (solid+solvent) about 0.5 to 12.5% carbon black particles and about 60 to 90% electrically conductive metal particles with 1 to 10 percent carbon black being preferred and 1 to 5 being most preferred.

At this time, reference should be had to FIGS. 1 to 4 for an illustration of a keyboard incorporating circuitry having contactors and contacts made of the dry ink composition of the invention.

The keyboard 10 comprises a frame 11 having top openings 12 for buttons or keys 13. The buttons 13 are moveable downwardly to depress a snappable dome 14 of the type shown in U.S. Pat. Nos. 3,860,771 and 4,066,851. As shown in U.S. Pat. No. 4,066,841, the dome is a portion of a foldable sheet or substrate 15 preferably of polyester such as MYLAR, e.g., of 4 to 20 mils thickness.

Figure 4:
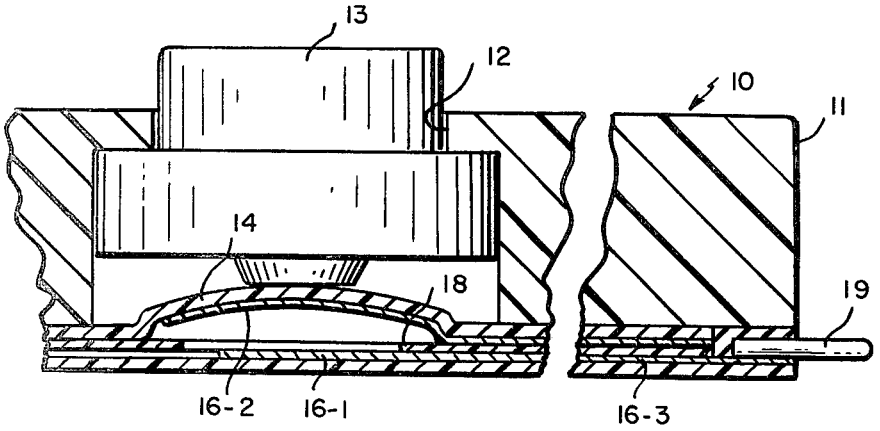
FIG. 4 is a sectional view taken along line 4—4 in FIG. 1.

A current pattern comprising contacts 16-1, contactors 16-2 and circuit lines 16-3 is screened on the sheet 15 using the electrically conductive screening ink as described in Example 1 which follows or the other Examples or by other conventional methods known in the art, e.g., spraying, brushing, etc. The contactors 16-2 extend into the underside of the dome as shown in FIG. 4 as well as in U.S. Pat. Nos. 3,860,771 and 4,066,851.

A slit 17 in the sheet is preferably formed in order to facilitate folding of sheet section 15-1 over sheet section 15-2. A non-conductive snap through layer 18 such as polyester having in register openings 18-1 is provided and is positioned between the folded sheet sections 15-1 and 15-2 as shown in FIG. 4 and U.S. Pat. No. 4,066,851.

Terminal pins 19 inserted into frame 10 engage the circuit lines 16-3 and may be soldered thereto or glued thereto using electrically conductive adhesive to provide power and derive the signals indicting the depression of a button 13 which causes the dome 14 to snap and urge a contactor 16-2 against an underlying contact 16-1. Alternatively, a tail section such as shown in U.S. Pat. No. 4,066,851 may be provided to facilitate contact with the circuit lines 16-3. As used in the claims calling for the dry ink, the term binder means the solids remaining after the solvent has been driven off.

The following examples illustrate the invention and are not intended to be limiting. All temperatures are in degrees F. and all weights are in grams.

EXAMPLE I

The preferred electrically conductive ink composition suitable for screening is prepared by mixing 560.4 grams of #140-1303 polyester resin binder (30% solids, 70% solvent), called Letdown Base and sold by General Formulations of Sparta, Michigan, with 1008.0 grams of Handy and Harmon Silflake 135, sold by Handy and Harmon Industrial Products Division, 850 Third Avenue, New York, New York, in a glass jar. The binder is first added to the glass jar (quart size) and the Silflake 135 is poured in a little at a time and mixed (4 to 5 minutes) with a spatula to prepare a uniformly colored composition. At this time, 24.0 grams of carbon black, Vulcan XC-72R (fluffy) 30 millimicrons particle size made by Cabot Corporation, 125 High Street, Boston, Massachusetts, is added to the jar and mixed for about 4 to 5 minutes with the Silflake 135 binder composition until the resulting composition is uniform in color. At this time, 108.0 grams solvent (thinner) 140-1167 also made by General Formulation of Sparta Michigan [solvent comprises cyclohexanone-γ butyrolactone aromatic naptha- (same solvent as in binder)] is added to the composition and mixed for about 4 to 6 minutes to form a screening ink. The resulting mixture while in the jar is placed in a bell jar and covered and vacuum (0.1 TORR) is applied for 10 minutes.

In order to screen circuits as shown in the figures, a MYLAR polyester sheet (e.g., 5 mills thickness) is placed under a conventional framed wire mesh screen (200 mesh) having a mask with pattern opening in the shape of circuit to be formed attached to the screen side closest the MYLAR polyester sheet. The screening ink is poured to flood the mesh screen and a rubber squeegie is used to force the ink uniformly into the screen and mesh and onto the MYLAR polyester sheet to form a circuit pattern such as shown in FIG. 1 comprising circuit lines, contacts and contactors. The thickness of the mask is about 1 mil and is conventionally made using Bluepoly-3 film (U.S. Pat. No. 3,503,743) sold by ULANO of 210 86th Street, New York, New York. The screened on ink now in the shape of a circuit is exposed to air and dried for 5 minutes at 250° F. using light or preferably in an oven and is then preferably further dried in an oven for 30 minutes at 300° F. A keyboard was then assembled using the MYLAR sheet with the screened on circuit as shown in the figures. The dried ink of the circuit had a thickness of about 0.75 mils and comprised by weight about 2.0% carbon black, 84% silflake 135 and 14% binder (as solid).

EXAMPLES 2 to 5

In the same manner as set forth in Example 1 an electrically conductive screening ink was prepared using the following ingredients in the weight in grams as shown below.

| EXAMPLE | BINDER* | CARBON BLACK | SILFLAKE 135 | SOLVENT | NICKLE 287 |
|---|---|---|---|---|---|
| 2 | 46.7 | 1.0 | 85.0 | 7.0 | |
| 3 | 46.7 | .5 | 85.5 | 6.0 | |
| 4 | 60.0 | 5.0 | 77.0 | 10.0 | |
| 5 | 80.0 | 10.0 | 66.0 | 15.0 | |
| 6 | 46.7 | 2.0 | 42.0 | 9.0 | 42.0 |

*Binder is 30% solids and 70% solvent.

The binder, carbon black, silflake and solvent used were the same as used in EXAMPLE 1. The nickle used was powder type 287 made by International Nickle Company, Inc., New York, New York. The solids in the binder is calculated by multiplying 0.3 times the amount of binder used in grams SILFLAKE 135 is a silver flake sold by Handy and Harmon Co. (See U.S. Pat. No. 3,140,342, Example 5).

The dried ink formed from Examples 2 to 6 had about the following percentages of solids by weight:

Ex. 2—1% carbon black, 85% silflake 135 and 14.0% binder;

Ex. 3—0.5% carbon black, 85.5% silflake 135 and 14.0% binder;

Ex. 4—5% carbon black, 77.0% silflake 135 and 18.0% binder;

Ex. 5—10% carbon black, 66.0% silflake 135 and 24.0% binder;

Ex. 6—2% carbon black, 42.0% silflake 135, 14.0% binder and 42% nickel.

Other suitable carbon blacks, preferably such as the CF type (electrically conductive) may be selected from the text entitled Materials and Compounding ingredients for Rubber and Plastics, 1975, compiled by Rubber World, published by Publishers Printing Company, Louisville, Kentucky (see pages 407 to 423).

We claim:

1. Keyboard comprising top and bottom non-conductive sheet means, said sheet means having a plurality of contacts, said top sheet means having a plurality of contactors, each of said contactors in register with a different one of said contacts and each pair forming at least a portion of a switch, said contactors normally spaced apart from said contacts and depressible to engage said contacts, at least one of said contactors or contacts comprising a dry, electrically conductive ink of electrically conductive metal particles, a polymeric binder and about 0.5 to about 12.5% by weight, of carbon black particles based on the total weight of the carbon black, metal particles and binder, said binder comprising about 6 to 30% by weight of the ink based on the total weight of binder, metal particles and carbon black and said metal particles comprising about 60 to 90% by weight of the ink based on the total weight of binder, metal particles and carbon black.

2. The keyboard of claim 1 in which both the contactors and contacts comprise said ink.

3. The keyboard of claim 2 in which the top and bottom sheet means form a single larger unitary sheet means which has a portion folded over another portion.

4. The keyboard of claim 3 in which circuit lines of said ink are selectively coupled to said contacts and contactors.

5. The keyboard of claim 2 in which the carbon black comprises 0.5 to 5% of the dried ink.

6. The keyboard of claim 5 in which the metal particles comprise silver, nickel or a combination of same.

7. The keyboard of claim 5 in which the carbon black comprises about 1.0 to about 5% by weight of the ink.

8. The keyboard of claim 1 in which the contactors are supported on the underside of a snappable dome formed in the top sheet.

9. A switch comprising a contact and a contactor for engagement therewith, at least the contactor or contact comprising a dry, electrically conductive ink containing a polymeric binder and electrically conductive metal particles, the improvement of said dry ink also containing about 0.5 to about 12.5% by weight of carbon black particles based on the total weight of the carbon black, metal particles and binder, said ink comprises by weight about 6 to about 30% of binder and about 0.5 to about 12.5% by weight of carbon black particles.

10. The switch of claim 9 in which both the contactor and contact are made of said dry ink.

11. The switch of claim 10 in which said ink comprises about 0.5 to about 5% by weight of carbon black particles.

12. The keyboard of claim 6 in which the binder is polyester.

13. The switch of claim 11 in which the metal particles are silver, nickel or a combination of both.

14. The switch of claim 13 in which the binder is polyester.

* * * * *